US008445803B1

(12) United States Patent
Cavailles

(10) Patent No.: US 8,445,803 B1
(45) Date of Patent: May 21, 2013

(54) HIGH POWER ELECTRICAL SWITCHING DEVICE

(75) Inventor: Charles Cavailles, Issy-les-Moulineaux (FR)

(73) Assignee: Itron, Inc., Liberty Lake, WA (US)

( * ) Notice: Subject to any disclaimer, the term of this patent is extended or adjusted under 35 U.S.C. 154(b) by 46 days.

(21) Appl. No.: 13/304,827

(22) Filed: Nov. 28, 2011

(51) Int. Cl.
*H01H 9/44* (2006.01)

(52) U.S. Cl.
USPC ... 218/22; 218/8; 218/12; 218/45; 200/50.32; 200/334; 200/18; 200/42.01

(58) Field of Classification Search
USPC ..... 218/8, 22, 12, 45; 200/50.32, 334, 200/18, 42.01
See application file for complete search history.

(56) References Cited

U.S. PATENT DOCUMENTS

| | | | | |
|---|---|---|---|---|
| 4,464,642 | A * | 8/1984 | Yamagata et al. | 335/201 |
| 5,596,184 | A * | 1/1997 | Mitsuhashi et al. | 218/32 |
| 6,376,788 | B1 * | 4/2002 | Jones et al. | 200/244 |
| 6,504,116 | B2 * | 1/2003 | Nishikawa | 200/6 B |
| 6,750,409 | B1 * | 6/2004 | Samodell | 200/50.32 |
| 6,903,290 | B2 * | 6/2005 | Coppola | 200/334 |
| 7,141,751 | B2 * | 11/2006 | Kang et al. | 218/22 |
| 2004/0069603 | A1 * | 4/2004 | Richter | 200/50.01 |
| 2005/0189206 | A1 * | 9/2005 | Takeda | 200/400 |

FOREIGN PATENT DOCUMENTS

GB 2280063 1/1995

OTHER PUBLICATIONS

Jun. 13, 2012 Office Action issued in Canadian Patent Application No. 2,759,872.

* cited by examiner

*Primary Examiner* — Truc Nguyen
(74) *Attorney, Agent, or Firm* — Dority & Manning, P.A.

(57) ABSTRACT

An electrical switching device and method are disclosed. The electrical switching device can include two movable contacts. During opening of the switching device, the two movable contacts move in a first direction until one of the movable contacts engages a blocking member. The other movable contact continues in the first direction, effecting opening of the switching device. In a particular implementation, the movable contact that engages the blocking member "bounces" in a second direction after contacting the blocking member. This causes the contacts of the switching device to be separated very quickly, reducing electrical arcing during opening of the switching device.

20 Claims, 4 Drawing Sheets

HIGH POWER ELECTRICAL SWITCHING DEVICE

FIELD OF THE SUBJECT MATTER

The presently disclosed subject matter relates generally to high power electrical switching devices, and more particularly, to high power electrical switching devices that reduce arcing between electrical contacts during operation of the switching device.

BACKGROUND OF THE SUBJECT MATTER

Electrical switching devices are used in numerous environments, including for example, to control the supply of electrical power to various loads and other devices. For instance, switching devices are used in high power relays and/or circuit breaker devices to connect or disconnect electrical power downstream electrical loads. Electrical switching devices can be used in utility meters to control the supply of power to an electrical utility consumer. For instance, switching devices can be used in utility meters to selectively connect or disconnect power to electrical utility consumers.

Typical electrical switching devices execute at least two movements. In a first movement, the electrical switching device moves contacts from an opened state to a closed state to provide electrical power to downstream devices. In a second movement, the electrical switching device moves contacts from a closed state to an open state to disconnect electrical power from downstream devices. In higher power applications, the opening of electrical contact can generate an electrical arc that can lead to deterioration of the switching device. For instance, the electrical arc can cause increased temperatures and damage to the contacts.

Electrical switching devices are typically designed with at least two contacts. In known prior devices, one of the contacts is fixed and the other contact is movable relative to the fixed contact. To reduce electrical arcing, manufacturers try to make the movable contact move relatively faster during opening of the switching device. The switching devices, however, are limited in addressing the arcing time during opening of the switching because at least one of the contacts is in a fixed location.

Thus, a need exists for an electrical switching device that reduces arcing time more efficiently than known switching devices utilizing fixed contact positions.

SUMMARY OF THE SUBJECT MATTER

In view of the recognized features encountered in the prior art and addressed by the presently disclosed subject matter, an improved electrical switching device for high power switching is provided. In accordance with the presently disclosed subject matter, such improvements may be provided by way of using at least two movable contacts in an electrical switching device.

For instance, one exemplary embodiment of the present disclosure is directed to an electrical switching device. The electrical switching device includes a first movable contact and a second movable contact. The electrical switching device further includes a blocking member configured for engagement with the second movable contact. During opening of the electrical switching device, the first movable contact and the second movable contact move in a first direction until the second movable contact engages the blocking member. After the second movable contact engages the blocking member, the first movable contact continues moving in the first direction, thereby causing the first movable contact to separate from the second movable contact. In a particular variation of this exemplary embodiment, the second movable contact moves in a second direction after the second movable contact engages the blocking member.

The presently disclosed subject matter equally relates to both apparatus and related and/or associated methodology. For example, another exemplary embodiment of the present disclosure is directed to a method of operating an electrical switching device having a first movable contact, a second movable contact, and a blocking member configured for engagement with the second movable contact. The method includes, moving the first movable contact and the second movable contact in a first direction; blocking movement of the second movable contact in the first direction with the blocking member; and after blocking movement of the second movable contact, continuing movement of the first movable contact in the first direction causing the first movable contact to separate from the second movable contact, thereby opening the electrical switching device.

Yet another exemplary embodiment of the present disclosure is directed to a utility meter having high current elements corresponding to a line side terminal assembly and a load side terminal assembly. Each of the line side terminal assembly and the load side terminal assembly are respectively configured for insertion into a utility meter socket. The utility meter further includes a switching device for connecting or disconnecting electrical power from the line side terminal assembly to the load side terminal assembly. The switching device includes a first contact, a second contact configured to be placed in electrical communication with the first contact, and a blocking member configured for engagement with the second contact. During opening of the switching device, the first contact and the second contact move in a first direction until the second contact engages the blocking member. After the second contact engages the blocking member, the first contact continues moving in the first direction, thereby causing the first contact to separate from the second contact.

Additional aspects and advantages of the presently disclosed subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the presently disclosed subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the presently disclosed subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the presently disclosed subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the presently disclosed subject matter, including the best mode thereof, directed to one of ordinary skill in the art, is set forth in the specification, which makes reference to the appended figures, in which.

Figure 1:
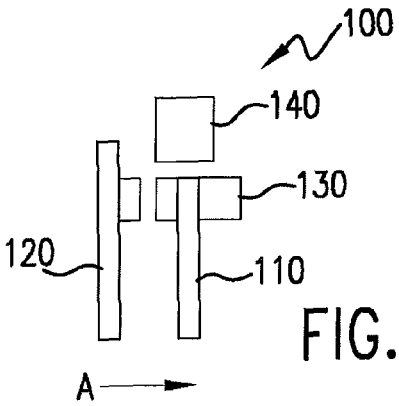
FIG. 1 represents an electrical switching device according to an exemplary embodiment of the present disclosure.

Repeat use of reference characters throughout the present specification and appended drawings is intended to represent same or analogous features, elements, or steps of the presently disclosed subject matter.

DETAILED DESCRIPTION OF THE PREFERRED EMBODIMENTS

The presently disclosed subject matter is generally concerned with an electrical switching device that includes two movable contacts. During opening of the switching device, the two movable contacts move in a first direction until one of the movable contacts engages a blocking member. The other movable contact continues in the first direction, thereby opening the switching device. In a particular implementation, the movable contact that engages the blocking member "bounces" in a second direction after contacting the blocking member. This causes the contacts of the switching device to be separated very quickly, reducing electrical arcing during opening of the switch.

Selected combinations of aspects of the disclosed technology correspond to a plurality of different embodiments of the presently disclosed subject matter. It should be noted that each of the exemplary embodiments presented and discussed herein should not insinuate limitations of the presently disclosed subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

Figure 6:
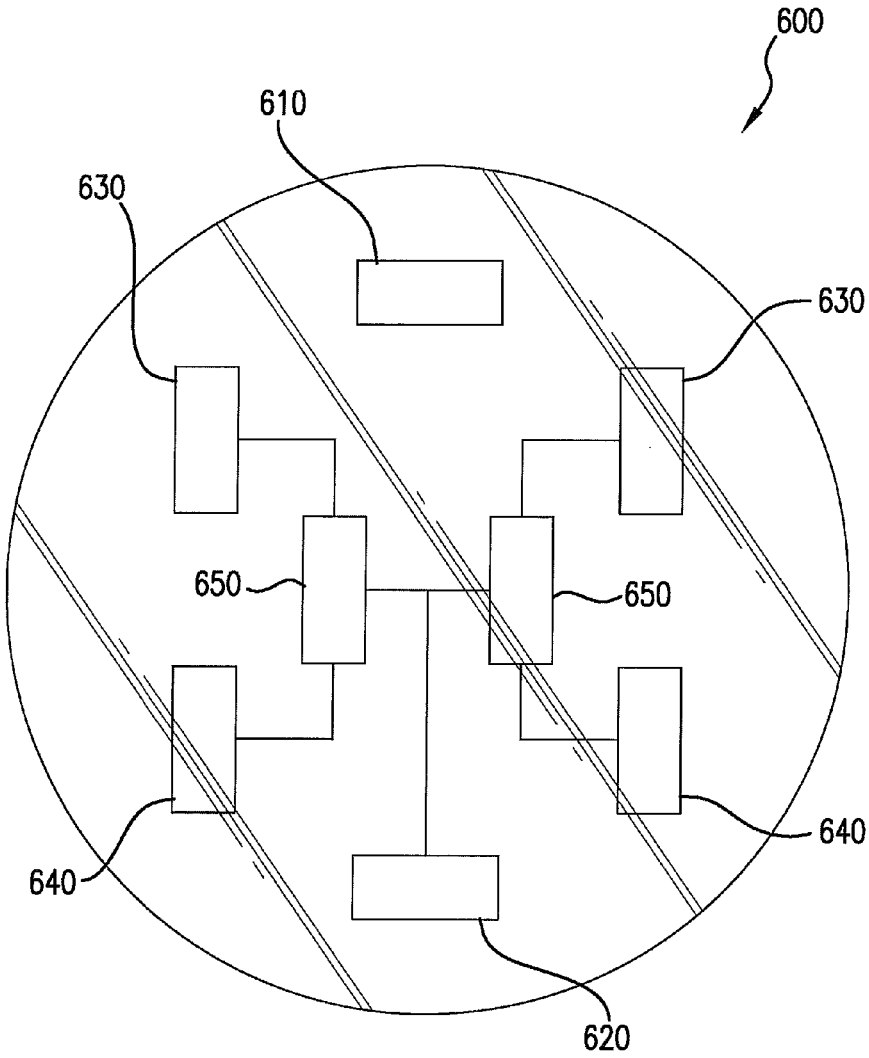
FIG. 6 represents an electricity meter having an electrical switching device according to an exemplary embodiment of the present disclosure.

Reference will now be made in detail to the exemplary embodiments of the subject electrical switching device. Referring now to the drawings, FIG. 1 illustrates an exemplary electrical switching device 100 according to an exemplary embodiment of the present disclosure. While certain embodiments of the electrical switching device will be made with reference to use with a utility meter, those of ordinary skill in the art, using the disclosures provided herein, should understand that the electrical switching device can be used to control the supply of electrical power to any electrical load or device. For instance, the electrical switching device can be used as part of a high power relay, circuit breaker, or other high power switching device. Accordingly, the combination of the presently disclosed subject matter with an electricity meter as illustrated in FIG. 6 is representative only, and is intended to also represent combination of the presently disclosed subject matter with other such devices as referenced herein, or others as may be practiced by one of ordinary skill in the art.

Electrical switching device 100 includes a first movable contact 110 and a second movable contact 120. Electrical switching device 100 can have an "open" position and a "closed" position. When electrical switching device 100 is in the closed position, the first movable contact 110 is in electrical communication with the second movable contact 120 such that electrical power can flow through electrical switching device 100. When electrical switching device 100 is in the open position, the first movable contact 110 is separated from the second movable contact 120 so that no electrical power flows through the electrical switching device 100.

In accordance with a particular aspect of the present disclosure, first movable contact 110 and second movable contact 120 are movable in direction A. Anything can be used to impart motion to the first movable contact 110 and the second movable contact 120. For instance, electromagnets or an electrical motor of various types (such as a conventional brush motor or stepping motor) can be used to cause the first movable contact 110 and the second movable contact 120 to move in direction A. Alternatively, the first movable contact 110 and the second movable contact 120 can be flexible contacts that behave as springs. The spring contacts 110 and 120 can be biased towards direction A such that the contacts will move in direction A unless their respective movement is impeded. The present illustrations are intended to represent all such variations, as will be understood by those of ordinary skill in the art from the complete disclosure herewith.

To control movement of first movable contact 110 and second movable contact 120, electrical switching device 100 can further include an arresting member 130 and a blocking member 140. Arresting member 130 is configured for selective engagement with first movable contact 110. As will be discussed in detail below, actuation of arresting member 130 effects opening and closing of electrical switching device 100. Blocking member 140 is configured for engagement with second movable contact 120. Blocking member 140 is used to block movement of the second movable contact to cause the first movable contact 110 and the second movable contact 120 to be separated quickly during opening of the electrical switching device 100.

With reference now to FIGS. 1-5, respective aspects of operation of electrical switching device 100 will be discussed in detail. FIG. 1 illustrates the electrical switching device in the open position. In the open position, the first movable contact 110 is separate from the second movable contact 120. The first movable contact 110 is in engagement with the arresting member 130 to prevent movement of the first movable contact 110 in the A direction.

Figure 2:
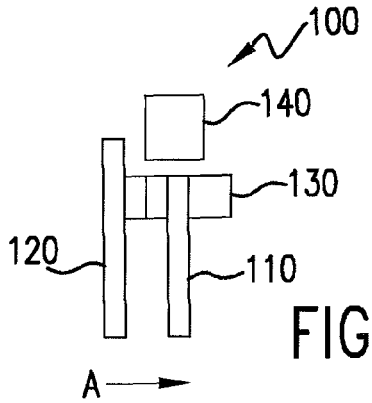
FIGS. 2-5 represent respective aspects of operation of the exemplary electrical switching device depicted in FIG. 1 according to an exemplary embodiment of the present disclosure.

To close electrical switching device 100, second movable contact 120 is moved in direction A towards first movable contact 110 until second movable contact 120 comes into electrical communication with first movable contact 110 as shown in FIG. 2. After the second movable contact 120 has come into electrical communication with the first movable contact 110, the electrical switching device 100 is in the closed position. The electrical switching device 100 will remain in the closed position until the arresting member 130 is moved out of engagement with the first movable contact 110.

Figure 3:
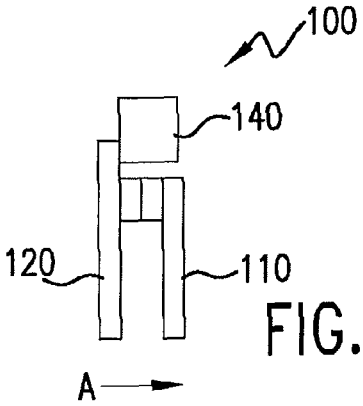

FIG. 3 depicts the state of the electrical switching device 100 after arresting member 130 has been removed such that arresting member 130 no longer impedes movement of first movable contact 110. An electromagnet, electric motor, or other suitable actuating device can be used to adjust the position of arresting member 130 such that arresting member is no longer in engagement with first movable contact 110. Once the arresting member 130 is moved out of engagement with the first movable contact 110, both the first movable contact 110 and the second movable contact 120 move in direction A until the second movable contact 120 engages the blocking member 140.

Figure 4:
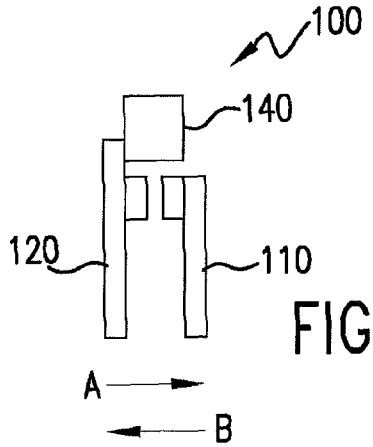

As shown in FIG. 4, after the second movable contact 120 engages blocking member 140, the first movable contact 110 continues to move in direction A causing the first movable contact 110 to separate quickly from the second movable contact 120, thereby opening the electrical switching device 100. In a particular implementation, second movable contact 120 bounces in a direction B after contacting the blocking member 140. This causes the first movable contact 110 and the second movable contact 120 to be moving in opposite directions during opening of the electrical switching device 100. In this manner, the subject matter of the present disclosure provides for rapid opening of the electrical switching device 100 such that electrical arcing is reduced.

Figure 5:
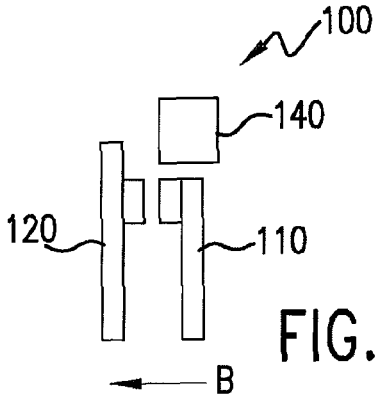

The electrical switching device 100 will remain in the open position until it is desired to close the electrical switching device 100. To close the electrical switching device 100, the first movable contact 110 and the second movable contact 120 are both moved in direction B as shown in FIG. 5. Anything can be used to move the first movable contact 110 and the second movable contact 120 in direction B, such as an electromagnet, electric motor, manual switch or other suitable device (and the present illustrations are intended to represent all such variations, as will be understood by those of ordinary skill in the art from the complete disclosure herewith). Once the first movable contact 110 and the second movable contact 120 have been moved in direction B, the arresting member 130 can be placed back into engagement with first movable contact 110 as shown in FIG. 1. The second movable contact 120 can then move in direction A toward the first movable contact 110 to effect closing of the electrical switching device 100.

Referring to FIG. 6, an exemplary representative utility meter 600 according to an exemplary embodiment of the present disclosure will be discussed in detail. FIG. 6 depicts a utility meter 600 having various components located within a housing. Utility meter 600 includes metrology circuitry 610 used for measuring consumption of electricity. Utility meter 600, in the example shown, further includes communication circuitry 620 for sending and/or receiving data to a utility through a suitable AMR/AMI network. Communication circuitry 620 can include RF wireless communication circuitry, PLC circuitry, or other suitable communication circuitry, and can be located within the housing of the meter or otherwise associated therewith.

Utility meter 600 includes line side terminals 630 that are configured to be coupled to the line side of a meter socket and load side terminals 640 that are configured to be coupled to the load side of a meter socket. In certain circumstances, it can be necessary or desirable for a utility to disconnect the power supplied to a utility customer. For instance, safety reasons could mandate that electrical power to the utility customer be shut off. In addition, failure of a consumer to pay utility bills can result in disconnection of electrical service.

Utility meter 600 includes switching device 650 to disconnect power from the line side terminals 630 to the load side terminals 640. Switching device 650 can be remotely actuated by the utility through commands sent via communication circuitry 620. Switching device 650 can include two movable electrical contacts and can operate in a similar manner to the switching device 100 depicted in FIGS. 1-5. In such manner, the utility meter 600 can provide for rapid disconnection of electrical power with reduced electrical arcing.

Figure 7:
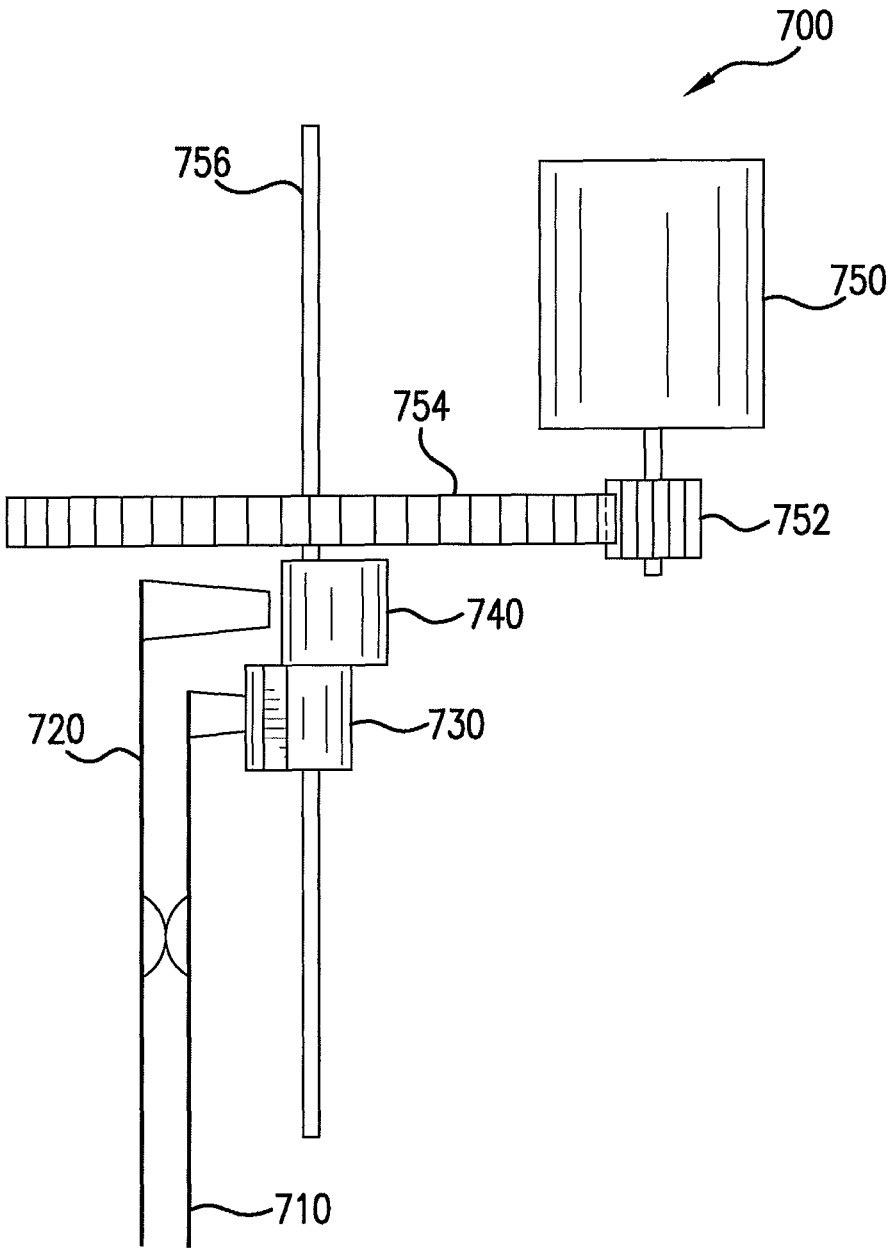
FIG. 7 represents an exemplary switching device according to an exemplary embodiment of the present disclosure.

FIG. 7 depicts an exemplary or representative switching device 700 per the presently disclosed subject matter that can be used, for instance, in association with a utility meter, such as utility meter 600 of FIG. 6. The electrical switching device 700 includes a first contact 710 and a second contact 720. First contact 710 and second contact 720 are in this exemplary embodiment flexible spring-like contacts that are biased towards the right direction. The electrical switching device 700 is in a closed state when the first contact 710 and the second contact 720 are in electrical communication with each other. The electrical switching device 700 is in an open state when the first contact 710 and the second contact 720 are separated from each other.

The exemplary switching device 700 uses a stepping motor 750 to actuate all movements of switching device 700. In particular, stepping motor 750 rotates a first gear 752 which in turn rotates a second gear 754 coupled to a rotatable shaft 756. The rotatable shaft 756 rotates non-concentric wheels, which respectively act as an arresting member 730 and blocking member 740 for the switching device 700. Arresting member 730 is configured for selective engagement with first contact 710. Blocking member 740 is configured for engagement with second contact 720. The flexible first contact 710 and flexible second contact 720 slip against the arresting member 730 and blocking member 740 so that they move progressively as the non-concentric wheels rotate. As is shown more particularly with reference to FIGS. 8-12, there are respective steps in arresting member 730 and the blocking member 740. The contacts 710 and 720 suddenly move in the right direction when the respective steps in the arresting member 730 and the blocking member 740 are reached.

Figure 8:
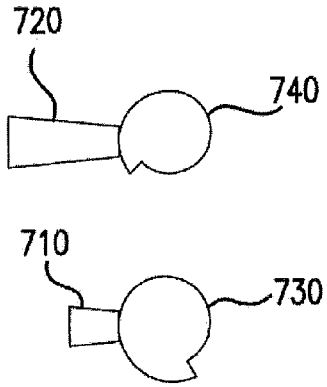
FIGS. 8-12 represent side views, respectively, of various positions of the blocking member and arresting member during operation of the exemplary switching device represented in FIG. 7 according to an exemplary embodiment of the present disclosure.

Operation of the switching device 700 will be explained in more detail with reference to FIGS. 8-12. FIGS. 8-12 depict side views of both the arresting member 730 and the blocking member 740 as the electrical switching device 700 is actuated from an open state to a closed state. FIG. 8 depicts the contacts 710 and 720 in the open state. The motor 750 is stopped such that the contacts 710 and 720 will remain in the open state as long as desired.

Figure 9:
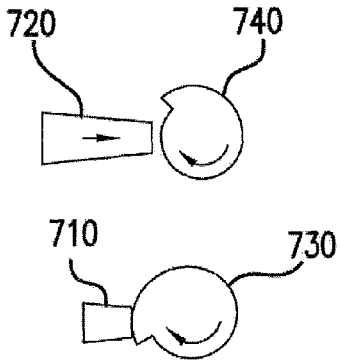

To close the switch, the electrical motor 750 rotates arresting member 730 and blocking member 740 such that second contact 720 reaches a step in blocking member 740. This causes second contact 720 to move to the right until it comes into electrical communication with first contact 710 as shown in FIG. 9. The second contact 720 no longer engages the blocking member 740 because it is resting against the first contact 710. This leaves a small gap between the blocking member 740 and the second contact 720. This small gap will be used to allow rapid opening of the switching device 700 as described below. The contacts 710 and 720 will remain in the closed state illustrated in FIG. 9 until it is desired to open the switching device 700.

Figure 10:
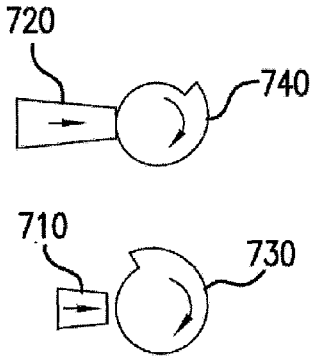

To open the switching device 700, the motor 750 is activated to rotate the blocking member 740 and the arresting member 730. This causes the first contact 710 to reach a step in the arresting member 730. When the step in the arresting member 730 is reached, the first contact 710 and the second contact 720 will both move in the right direction until the second contact member 720 engages the blocking member as shown in FIG. 10. The first contact 710 will continue moving in the right direction after the second contact has engaged the blocking member 740, causing the switch to open rapidly.

Figure 11:
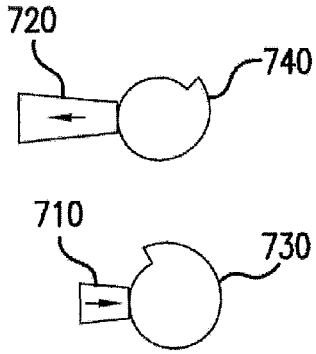

As shown in FIG. 11, second contact 720 bounces in the left direction after contacting the blocking member 740. As will be understood by those of ordinary skill in the art, "right" and "left" directions as used in the present illustrations are arbitrary directions resulting merely from the orientation of the illustrations. For example, "up" versus "down" directions could result with different orientations of the illustrated subject matter. This bouncing causes the first contact 710 and the second movable contact 720 to be moving in opposite directions during opening of the electrical switching device 700. In such manner, the subject matter of the present disclosure provides for rapid opening of the electrical switching device 700 such that electrical arcing is reduced.

Figure 12:
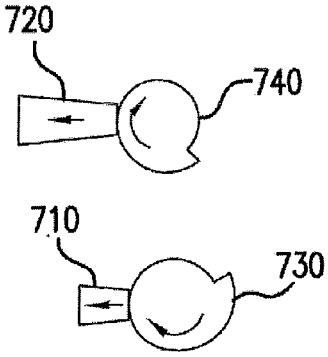

As shown in FIG. 12, the motor 750 rotates the blocking member 740 and arresting member 730 such that the first contact 710 and the second contact 720 are pushed back to the left direction. The contacts 710 and 720 can be held in such position by the blocking member 740 and arresting member 730 until it is desirable to close the switching device 700.

While the presently disclosed subject matter has been described in detail with respect to specific embodiments thereof, it will be appreciated that those skilled in the art, upon attaining an understanding of the foregoing, may readily produce alterations to, variations of, and equivalents to such embodiments. Accordingly, the scope of the present disclosure is by way of example rather than by way of limitation, and the subject disclosure does not preclude inclusion of such modifications, variations and/or additions to the presently disclosed subject matter as would be readily apparent to one of ordinary skill in the art.

What is claimed is:

1. An electrical switching device, comprising:

a first movable contact;

a second movable contact;

a blocking member configured for engagement with said second movable contact;

wherein during opening of said electrical switching device, said first movable contact and said second movable contact move in a first direction until said second movable contact engages said blocking member, wherein after said second movable contact engages said blocking member, said first movable contact continues moving in the first direction, thereby causing said first movable contact to separate from said second movable contact.

2. The electrical switching device of claim 1, wherein said second movable contact moves in a second direction after said second movable contact engages said blocking member.

3. The electrical switching device of claim 1, wherein said electrical switching device comprises an arresting member configured for selective engagement with said first movable contact.

4. The electrical switching device of claim 3, wherein said electrical switching device further comprises an actuator configured to adjust the position of said arresting member to effect opening and closing of the electrical switching device.

5. The electrical switching device of claim 4, wherein during opening of said electrical switching device, said actuator removes said arresting member from engagement with said first movable contact such that said first movable contact and said second movable contact move in the first direction.

6. The electrical switching device of claim 4, wherein during closing of said electrical switching device, said actuator moves said arresting member into engagement with said first movable contact.

7. The electrical switching device of claim 1, wherein said electrical switching device is configured to move said first and second movable contacts in a second direction after opening of said electrical device.

8. The electrical switching device of claim 4, wherein said actuator comprises an electric motor.

9. The electrical switching device of claim 8, wherein said arresting member comprises an a non-concentric wheel actuated by said electric motor.

10. The electrical switching device of claim 1, wherein said electrical switching device is incorporated into an electrical utility meter.

11. A method of operating an electrical switching device having a first movable contact, a second movable contact, and a blocking member configured for engagement with the second movable contact, the method comprising:

moving the first movable contact and the second movable contact in a first direction;

blocking movement of the second movable contact in the first direction with the blocking member; and after blocking movement of the second movable contact, continuing movement of the first movable contact in the first direction causing the first movable contact to separate from the second movable contact, thereby opening the electrical switching device.

12. The method of claim 11, wherein the method comprises bouncing the second movable contact in a second direction relative to the blocking member after blocking movement of the second movable contact with the blocking member.

13. The method of claim 11, wherein the method further comprises moving the first movable contact and the second movable contact in a second direction after opening of the electrical switching device.

14. The method of claim 13, wherein after moving the first movable contact and the second movable contact in the second direction, the method further comprises actuating an arresting member such the arresting member engages the first movable contact, thereby preventing movement of the first movable contact in the first direction.

15. The method of claim 14, wherein the method further comprises bringing the second movable contact into electrical communication with the first movable contact, thereby closing the electrical switching device.

16. The method of claim 15, wherein the method further comprises actuating the arresting member to remove the arresting member from engagement with the first movable contact, thereby allowing the first movable contact and the second movable contact to move in the first direction.

17. The method of claim 16, wherein the arresting member comprises a non-concentric wheel, and actuation thereof comprises selectively rotating such non-concentric wheel.

18. A utility meter, comprising:

a base including high current circuit elements corresponding to a line side terminal assembly and a load side terminal assembly, each respectively configured for insertion into a utility meter socket;

a switching device for connecting or disconnecting electrical power from the line side terminal assembly to the load side terminal assembly, the switching device comprising:

a first contact;

a second contact configured to be placed in electrical communication with said first contact;

a blocking member configured for engagement with said second contact;

wherein during opening of said switching device, said first contact and said second contact move in a first direction until said second contact engages said blocking member, wherein after said second contact engages said blocking member, said first contact continues moving in the first direction, thereby causing said first contact to separate from said second contact.

19. The utility meter of claim 18, wherein said blocking member comprises a first non-concentric wheel actuated by a stepping motor.

20. The utility meter of claim 19, wherein said utility meter further includes a second non-concentric wheel actuated by said stepping motor, said second non-concentric wheel configured for engagement with said first movable contact.

* * * * *